US006388626B1

(12) United States Patent
Gamalielsson et al.

(10) Patent No.: US 6,388,626 B1
(45) Date of Patent: May 14, 2002

(54) ANTENNA DEVICE FOR A HAND-PORTABLE RADIO COMMUNICATION UNIT

(75) Inventors: Jonas Gamalielsson, Skövde (SE); Corbett Rowell, Clear Water Bay (HK); Johan Strand, Åkersberga (SE)

(73) Assignee: Allgon AB, Akersberga (SE)

( * ) Notice: Subject to any disclaimer, the term of this patent is extended or adjusted under 35 U.S.C. 154(b) by 0 days.

(21) Appl. No.: 09/462,087

(22) PCT Filed: May 14, 1998

(86) PCT No.: PCT/SE98/00899

§ 371 Date: Apr. 11, 2000

§ 102(e) Date: Apr. 11, 2000

(87) PCT Pub. No.: WO99/03166

PCT Pub. Date: Jan. 21, 1999

(30) Foreign Application Priority Data

Jul. 9, 1997 (SE) ..... 9702659

(51) Int. Cl.[7] ..... H01Q 1/27

(52) U.S. Cl. ..... 343/702; 343/700 MS; 343/895

(58) Field of Search ..... 343/702, 700 MS, 343/845, 846, 873, 895, 893, 896

(56) References Cited

U.S. PATENT DOCUMENTS 5,006,861 A 4/1991 Miller et al. ..... 343/848
5,797,084 A * 8/1998 Tsuru et al. ..... 455/73
5,798,737 A * 8/1998 Kanaba et al. ..... 343/895
5,870,066 A * 2/1999 Asakura et al. ..... 343/895
5,914,691 A * 6/1999 Mandai et al. ..... 343/728
5,926,139 A * 7/1999 Korisch ..... 343/702
6,075,500 A * 6/2000 Kurz et al. ..... 343/895

FOREIGN PATENT DOCUMENTS

WO WO85/02719 6/1985
WO WO95/24745 9/1995
WO WO96/27219 9/1996
WO WO97/18600 5/1997
WO WO97/49141 12/1997

OTHER PUBLICATIONS

Patent Abstracts of Japan, 09107238 A, Apr. 22, 1997, (KYOCERA CORP.).

* cited by examiner

*Primary Examiner*—Don Wong
*Assistant Examiner*—Shih-Chao Chen
(74) *Attorney, Agent, or Firm*—Jacobson Holman, PLLC

(57) ABSTRACT

An antenna device for a hand-portable radio communication unit including a casing with a ground plane means cooperating with the antenna device. The antenna device comprises first and second radiating elements (1*a*, 1*b*) being tuned to different resonant frequencies and having a common feed point (1*c*). The radiating elements (1*a*, 1*b*) are disposed in a compact arrangement on a support means (3) so as to be confined entirely in the casing (2).

35 Claims, 9 Drawing Sheets

ANTENNA DEVICE FOR A HAND-PORTABLE RADIO COMMUNICATION UNIT

FIELD OF THE INVENTION

The present invention relates to an antenna device for a hand-portable radio communication unit, in particular a mobile telephone, including a casing, in which a ground plane means having at least one edge is disposed. The antenna device comprises first and second radiating elements carried by support means, and said first and second radiating elements being tuned to different resonant frequencies.

BACKGROUND OF THE INVENTION

Such an antenna device is disclosed in the international patent application PCT/SE97/01046 (Allgon AB), wherein an embodiment shown in FIG. 3A includes first and second radiating elements in the form of flat meander-configured elements disposed on a flexible film carrier which is bent into a cylindrical shape. The cylindrical support means with the first and second meander elements are arranged as a cylindrical or somewhat conical element projecting upwards from a top portion of the telephone casing adjacent to a corner thereof. As is also generally known per se, the known antenna device includes a whip or rod antenna element, which is mechanically supported centrally in the projecting element and is movable between an operative extended position and a non-operative retracted position.

Thus, the previously known antenna device is basically located outside the casing as indicated above.

With this background, a main object of the present invention is to provide a compact antenna device which can be disposed substantially inside the casing so as to avoid any outwardly projecting sleeve or conical member, except for a possible extendable whip or rod antenna element. It is also desirable to make the whole radio communication unit or mobile telephone compact by such a measure.

Another object is to provide an antenna device having a low weight.

Still another object is to provide an antenna element having a satisfactory efficiency and bandwidth for each frequency in spite of a low volume of the device. The performance should be at least as good as for a conventional, stationary helix antenna.

Still another object is to provide a built-in antenna device, which can be manufactured in large series at low costs.

Still another object is to provide an antenna element also provided with a rod having a reduced total length (for a given radiating length).

SUMMARY OF THE INVENTION

According to a first aspect of the invention the main object stated above is achieved for an antenna device having the features stated as first and second radiating elements carried by a support means. Thus, the first and second radiating elements, each being tuned to a specific resonant frequency, are disposed in a compact arrangement on a support means, which is adapted to be mounted with the first and second radiating elements located in proximity of, i.e. adjacent to, one or two edges of the ground plane means so as to be confined entirely in the casing. The two radiating elements preferably extends with their longitudinal axes substantially in parallel to said one or two edges.

In a preferred embodiment, wherein the casing is shaped substantially as an elongated box with the antenna device located adjacent to an end port ion thereof, the support means, together with the first and second radiating elements, is dimensioned so as to extend transversely between the opposite longer sides of the elongated box constituting the casing.

Thus, the first and second radiating elements are confined entirely in the casing. However, it is possible to combine these first and second radiating elements with a third radiating element in the form of a whip or a rod, which is connectable to a feed point of the radiating elements so as to be coupled electrically in parallel to the first and second radiating elements. Preferably, the rod is movable between an operative extended position, located at least partially outside the casing, and a retracted position, located substantially inside the casing.

The first and second radiating elements are preferably constituted by flat substantially meander-configured elements or flat elongated substantially straight elements, whereby the weight of the antenna device can be kept very low. However, it is also possible to use helical elements.

In one preferred embodiment said first and second elements are located on mutually perpendicular sides of said support means.

These and other preferred features of the invention are stated in the dependent claims 2–19 and will appear from the detailed description below.

According to a second aspect of the invention, the main object stated above is achieved for an antenna of device having the features stated in any one of claims 20–22, i.e. with a rod element in combination with at least one internal radiating element having multiple turns.

This geometry may generally allow an arrangement wherein the rod element and the internal element have a relatively small electromagnetic interaction.

The invention also concerns a radio communication unit comprising an antenna device as defined in any one of the claims 1–22.

BRIEF DESCRIPTION OF THE DRAWINGS

The invention will now be explained more fully with reference to the appended drawings which illustate some preferred embodiments.

DETAILED DESCRIPTION OF PREFERRED EMBODIMENTS

Figure 1:
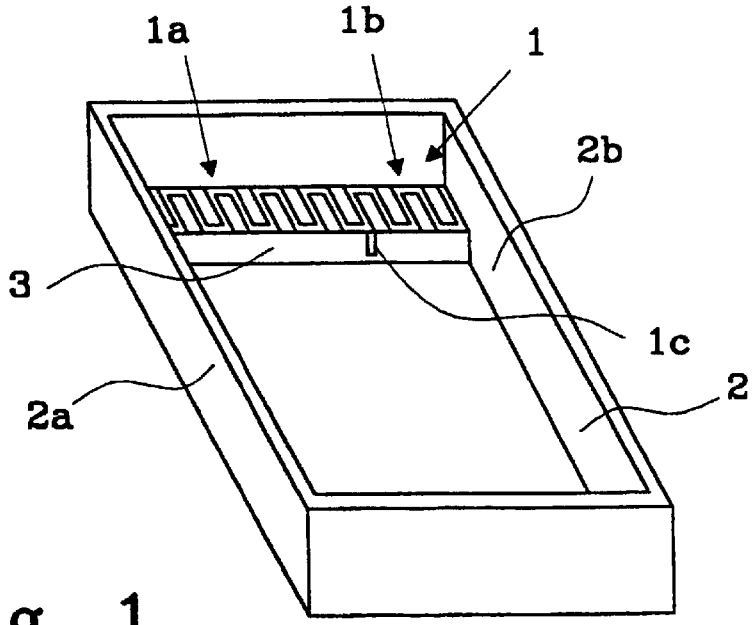
FIG. 1 shows, schematically, in a perspective view from the rear, a telephone casing with an interior antenna device according to the invention, the rear wall of the telephone casing being taken away for clarity.
Figure 4:
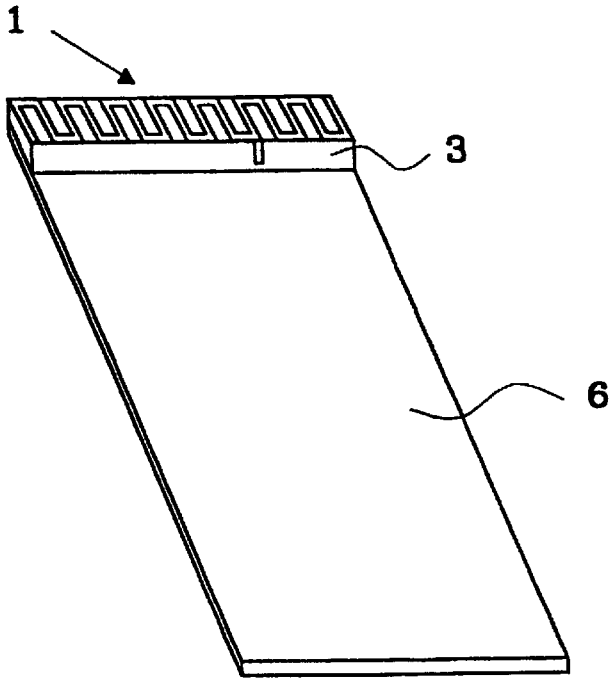
FIG. 4 shows the antenna device of FIG. 1, including a rectangular ground plane means.
Figure 11:
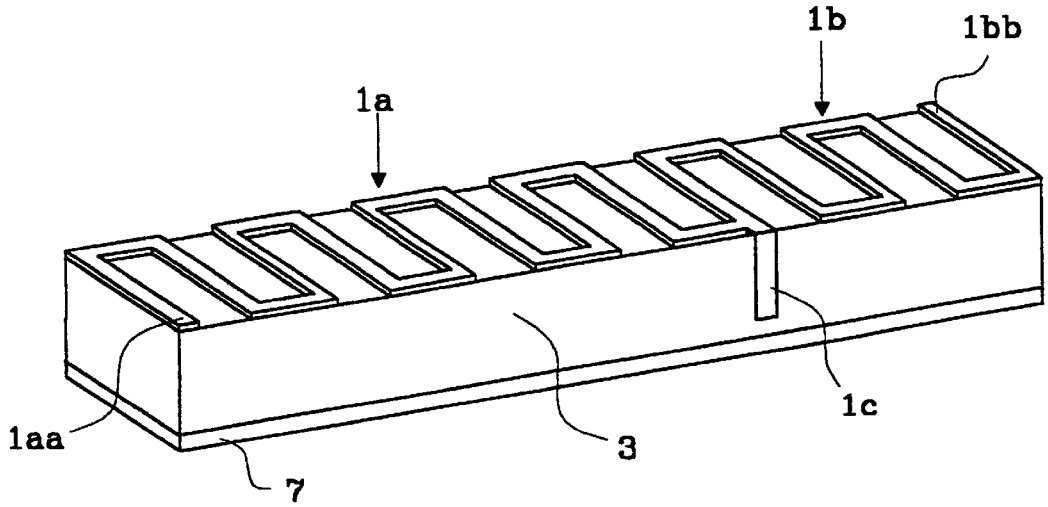
FIG. 11 shows, in a larger perspective view, the antenna device shown in FIGS. 1 and 4, including a support body.

With reference to FIGS. 1, 4 and 11, there is shown a first, basic embodiment of the antenna device according to the invention, the antenna device 1 being disposed in one end portion of an elongated, box-like casing 2 of a hand-portable mobile telephone. All parts of the telephone as such, including its electronic circuitry, are left out from FIG. 1, even the rear wall of the casing. Of course, the casing 2 is normally designed with smooth corners and a general shape making the telephone unit visually pleasant and convenient to hold in one hand by the user.

According to a first aspect of the present invention, the antenna device 1 comprises first and second radiating elements 1*a*, 1*b* carried by a support means 3, which in this embodiment is formed by a straight bar 3 constituted by a hollow, molded body of plastic material, such as polypropene or teflon, whereby the weight of the antenna device will be low. The bar 3 extends transversely between the opposite longer sides 2*a*, 2*b* of the casing 2 and can be snapped into the shown position.

The antenna elements 1*a* and 1*b* are constituted by flat meander-configured elements of an electrically conductive material, normally a metal material such as aluminium or copper. Although the meander element is shaped as a continuous meander element, there are two radiating elements 1*a* and 1*b* extending from a common feed point 1*c* in opposite directions to a respective free end 1*aa*, 1*bb* (FIG. 11). The two radiating elements 1*a*, 1*b* are tuned to different resonant frequencies allowing operation of the antenna device in two overlapping or separated frequency bands, for example 900 MHz and 1,8 GHz. The common feed point 1*c* is to be connected to a feeding circuitry of the telephone.

Figure 12:
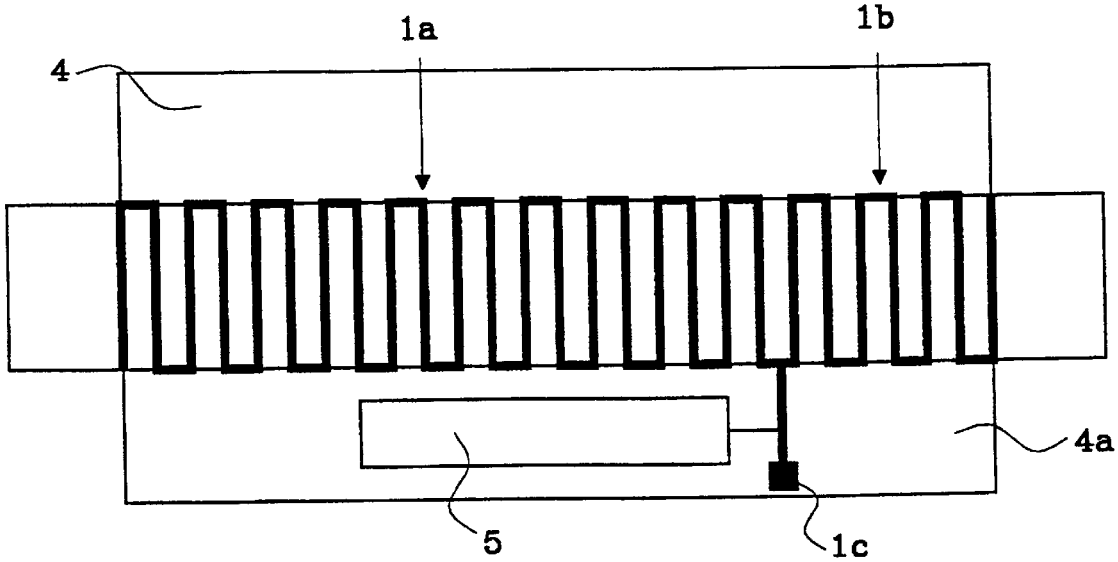
FIG. 12 shows, in a planar view, a plastic foil member with a meander-configured antenna device similar to the one shown in FIGS. 1, 4 and 11.

A convenient way of mounting the meander-configured radiating elements 1*a*, 1*b* onto the support body 3 is to use a plastic foil, which is securable onto the support body 3 by means of an adhesive agent. Preferably, as shown in FIG. 12, the plastic foil is provided with flap portions along at least two of its edges, preferably along all four edges, whereby the flap portions can be folded onto the side walls of the molded support body 3. If desired, an impedance matching circuit 5 may be disposed on one or more of the flap portions 4*a*.

Figure 5:
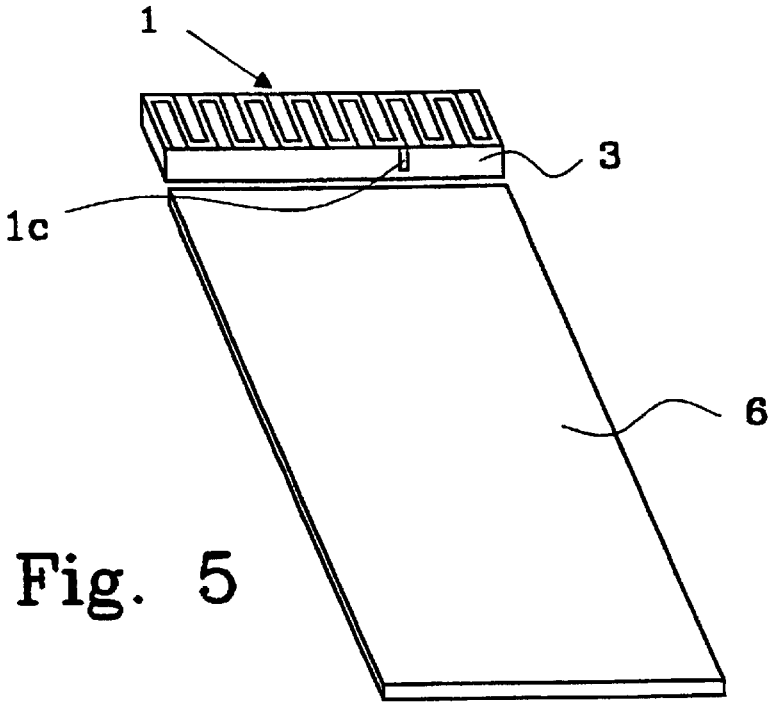
FIG. 5 shows a modified embodiment of the antenna device of FIG. 4.

Each one of the meander radiating elements 1*a*, 1*b* has a length of approximately $\lambda/4$, $\lambda$ being the respective wave length of the high frequency radiation, each radiating element cooperating with a ground plane 6, e.g. in the form of a metal layer on a dielectric substrate. Preferably, as will be apparent from FIGS. 1 and 4, the ground plane means 6 is extended over the whole area of the casing 2. However, it is not strictly necessary that the ground plane means is extended all the way underneath the antenna device 1. Such a modified embodiment is shown in FIG. 5.

According to a further aspect of the invention, as illustrated in FIG. 11, a protective device in the form of an electrically resistive layer 7 is mounted on the lower side of the support body 3 for absorbing electromagnetic radiation, which is transmitted from the two meander radiating elements 1*a*, 1*b* towards a part of the casing 2 which is designed to be held against the user's head.

Preferably, such a protective layer is constituted by a very thin metal layer, e.g. of aluminium, with a thickness in the order of 10–100 nm. Generally, such a protective layer should be positioned between a part of the casing being designed to be located adjacent to a body portion of a human being, on the one hand, and the radiating elements 1*a*, 1*b*, on the other hand.

Without being specifically mentioned, a protective layer of this kind can be arranged in all embodiments to be described further below.

Figure 2:
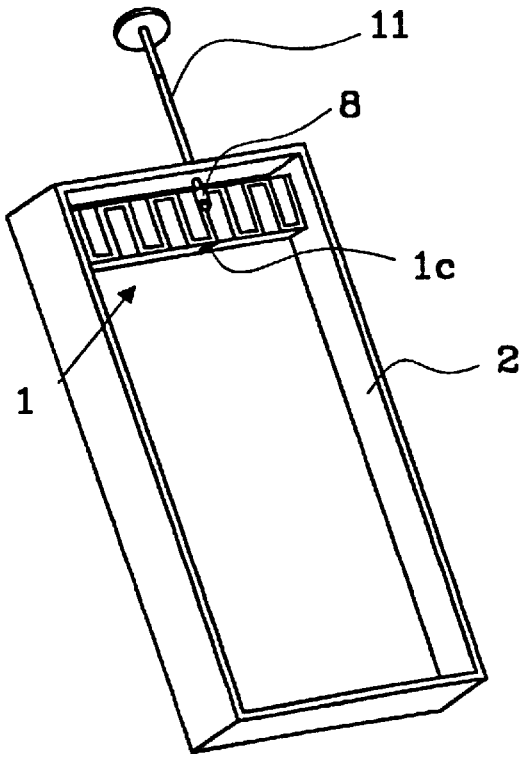
FIG. 2 shows, in a corresponding perspective view, a casing with a modified antenna device including a rod in an extended position.
Figure 3:
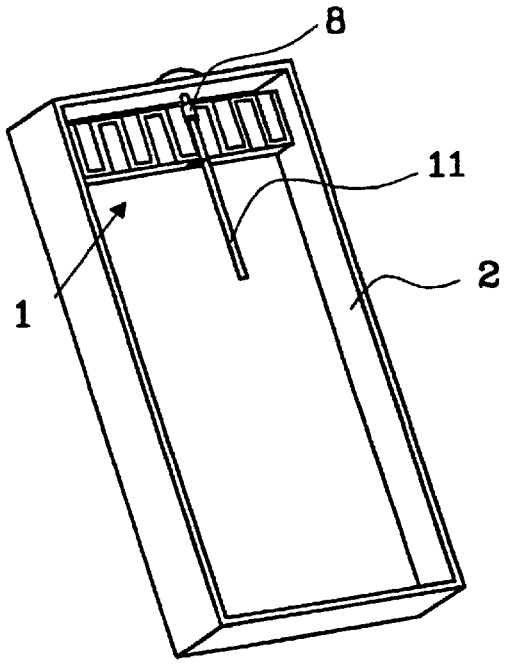
FIG. 3 shows the casing of FIG. 2 with the rod in a retracted position.

FIG. 2 shows an embodiment, which is exactly like the one in FIG. 1, except for the fact that a third radiating element in the form of a whip or rod 11 is added, the antenna rod 11 being connected at the common feed point 1*c*, i.e. electrically in parallel to the meander radiating elements 1*a* and 1*b*. As is known per se, the rod 11 is movable between an operative extended position, located at least partially outside the casing 2 (as shown in FIG. 2), and a non-operative retracted position, located substantially inside the casing 2, as shown in FIG. 3. The rod 11 is guided mechanically in a short sleeve member 8.

Figure 6:
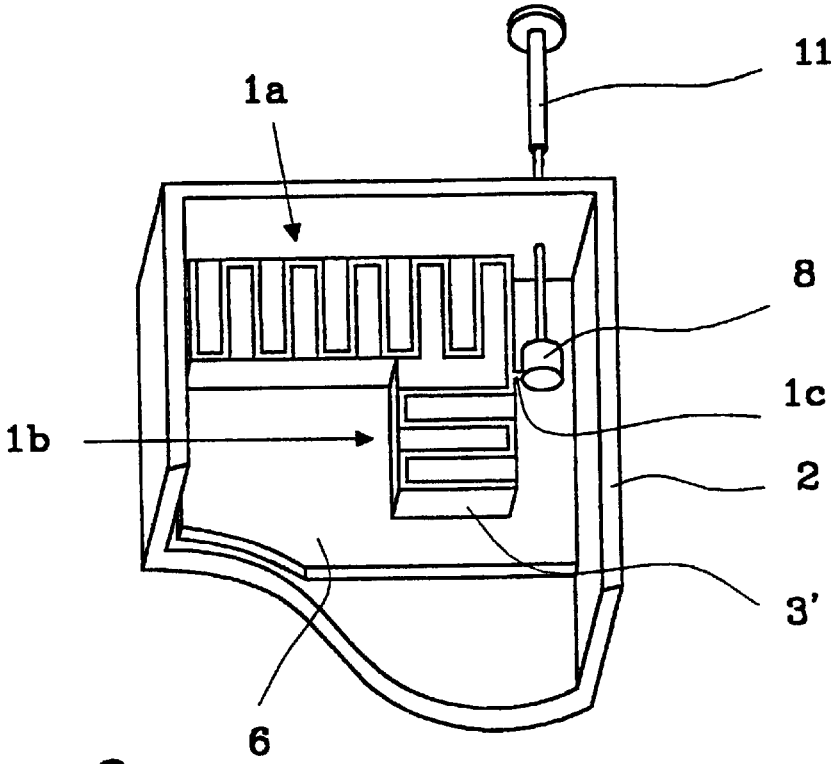
FIG. 6 shows, likewise schematically and in a perspective view, a second embodiment of the antenna device according to the invention.

In a second embodiment of the antenna device, as shown in FIG. 6, the meander-configured radiating elements 1*a* and 1*b* are mounted on a L-shaped support body 3', the first meander radiating element 1*a* being oriented with its longitudinal axis along one edge (the shorter edge) of the rectangular ground plane means 6, and the other meander radiating element 1*b* being oriented with its longitudinal axis adjacent and in parallel to the adjacent, longer edge of the ground plane means 6.

In this case, the common feed point 1*c* is located relatively close to the upper corner of the elongated box-like casing 2. So, an extendable antenna rod 11 can be conveniently located in this corner region, as is also apparent from FIG. 6. Although not shown specifically, the antenna rod 11 can be retracted fully into the casing upon being slid through the sleeve 8 at the common feed point 1*c*.

Figure 7:
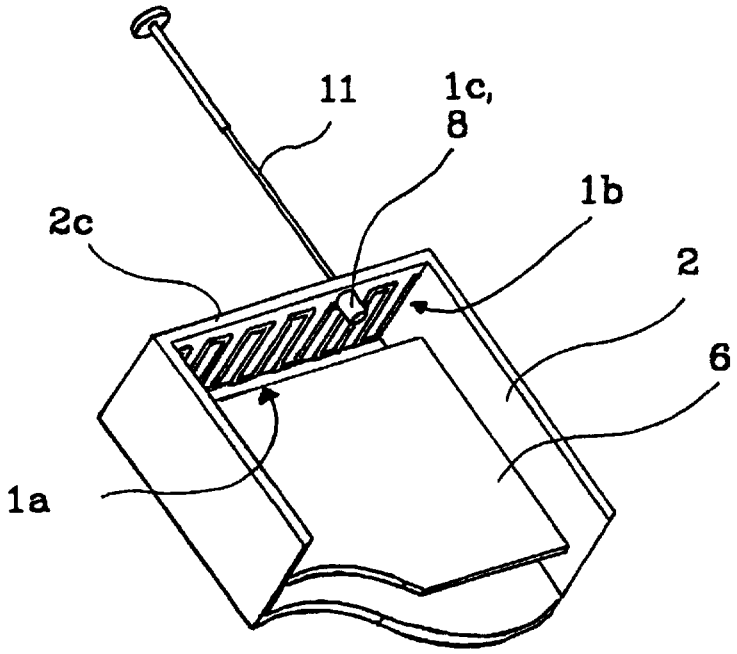
FIG. 7 shows, in a corresponding perspective view, a third embodiment of the antenna device.

In a third embodiment shown in FIG. 7, two meander-configured radiating elements 1*a* and 1*b* are mounted onto the upper, shorter end wall 2*c* of the casing 2. The elements 1*a*, 1*b* can be mounted either directly onto the inside of the casing wall 2*c*, serving as a support means, by means of a printed circuit board or by the intermediary of a plastic foil similar to the one shown in FIG. 12, preferably with only one, two or three flap portions.

In this case as well, the first and second radiating elements 1*a*, 1*b* have a meander-like pattern with multiple turns along a respective longitudinal axis from a common feed point: 1*c*. The elements 1*a*, 1*b* extends with their respective longitudinal axes in parallel to the shorter edge of the rectangular ground plane means 6, with which the radiating elements cooperate. In this embodiment as well, a retractable antenna rod 11 can be mounted in a guiding sleeve 8 at the common feed point 1*c*. As appears from FIG. 7, in this third embodiment, the meander elements 1*a*, and 1*b* are located in a plane which is perpendicular to the ground plane means 6.

Figure 13:
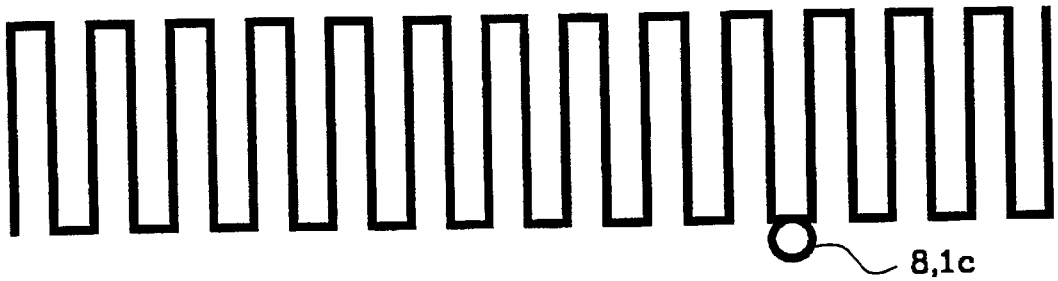
FIG. 13 shows a meander element similar to the one shown in FIG. 7.
Figure 14:
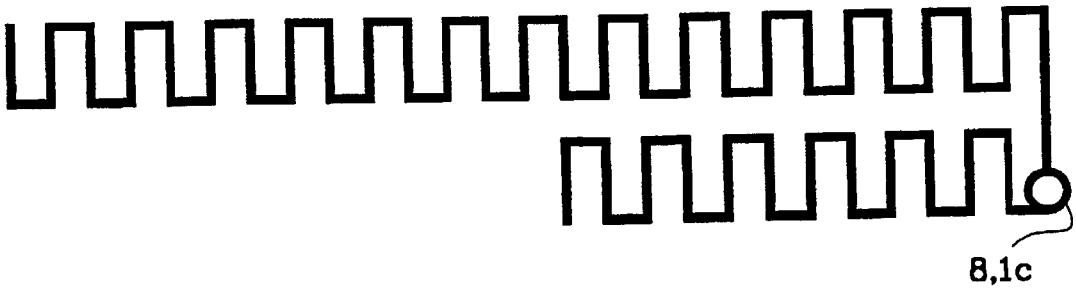
FIGS. 14 and 15 show schematically modified embodiments of the meander element shown in FIG. 13.
Figure 15:
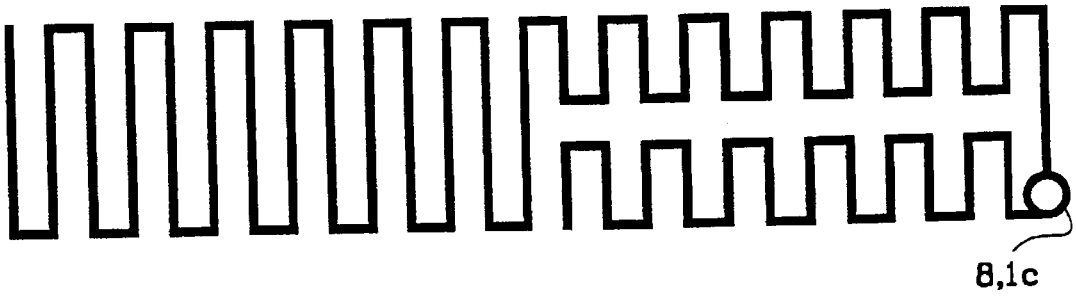

The exact configuration of the meander elements 1*a*, 1*b* may be modified in various ways, some of which are shown in FIGS. 13, 14 and 15, all these meander configurations being intended to be mounted at the inside of the casing wall 2*c* shown in FIG. 7. In FIGS. 13–15, the small circle represents the guiding sleeve 8 located at the common feed point 1*c*.

Figure 8:
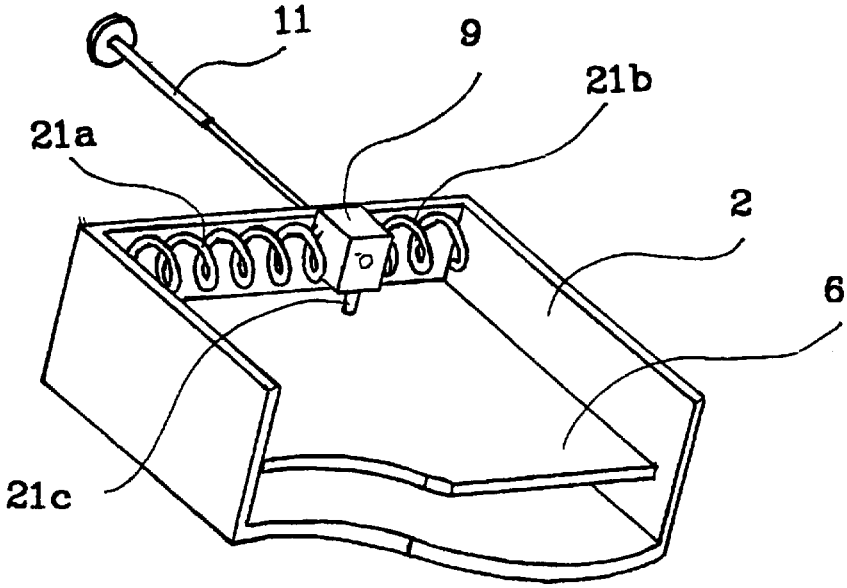
FIG. 8 shows, in a corresponding perspective view, a fourth embodiment of the antenna device.

In a fourth embodiment illustrated in FIG. 8, the meander-configured elements are replaced by helical elements 21*a*, 21*b* extending from a common feed point 21*c* to a respective free end.

In this case, the supporting means has the form of a box member 9 which holds the two helical elements 21*a* and 21*b* mechanically and in which these elements are electrically connected to the common feed point, which has the form of a downwardly projecting tab 21*c* to be connected to the feeding circuitry (not shown) located above the ground plane means 6. Like in the embodiments shown in FIGS. 1–5 and FIG. 7, the longitudinal axes of the helical elements 21*a*, 21*b* extend in parallel to the shorter edge of the rectangular ground plane means 6. There is also an optional retractable antenna rod 11 guided in a sleeve inside the element holder 9.

Figure 9:
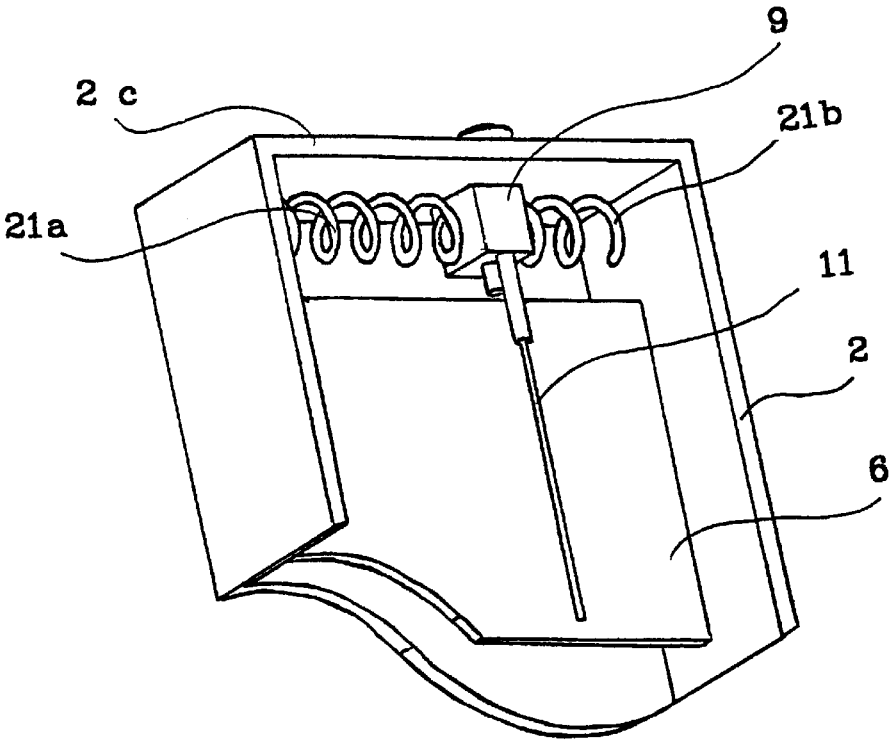
FIG. 9 shows, in. a corresponding perspective view, a fifth embodiment of the antenna device.

In a fifth embodiment shown in FIG. 9, there are also two helical radiating elements 21*a* and 21*b* supported by a holding box 9, the difference from FIG. 8 being that the ground plane means 6 is not extended all the way to the end wall 2*c* of the casing. So, the longitudinal axes of the helical elements 21*a* 21*b* are located substantially in the same plane as the ground plane means 6. There is also a rod antenna 11, shown in its retracted position.

Figure 10:
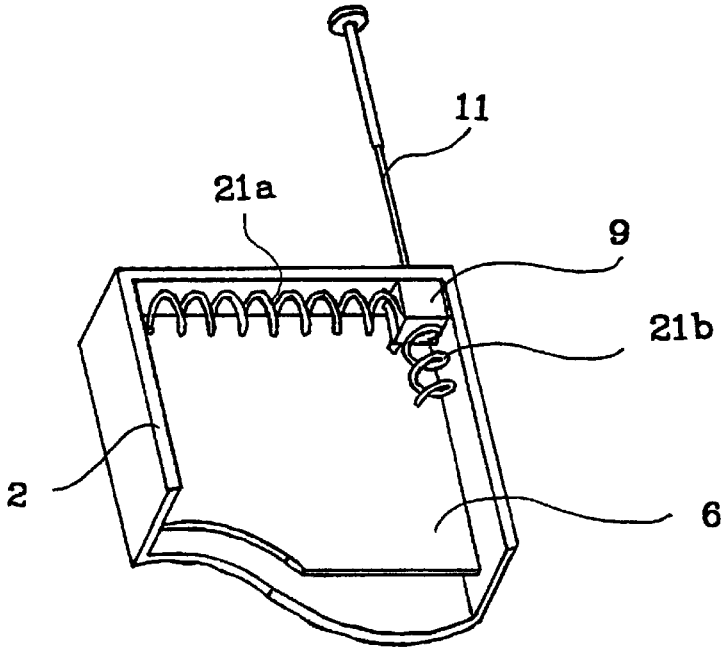
FIG. 10 shows, in a corresponding perspective view, a sixth embodiment of the antenna device.

Finally, FIG. 10 illustrates a sixth embodiment of the antenna device, including two helical elements 21*a*, 21*b*, located above the ground plane means 6. Here, the first helical 21*a* is oriented with its longitudinal axis in parallel to the shorter edge of the ground plane means 6, whereas the other helical element 21*b* is oriented with its longitudinal axis in parallel to the longer edge of the ground plane means 6.

The two helical elements 21*a*, 21*b* are securely held by a supporting box element 9 in the adjacent inner corner of the casing 2, a retractable rod 11 being also supported by the box element 9.

In the embodiments with helical elements 21*a*, 21*b* shown in FIGS. 8–10, a thin, dielectric sleeve is preferably disposed around each helical coil so as to provide an improved mechanical stability. Matching circuitry may be arranged on the printed circuit card carrying the ground plane means 6.

In all illustrated embodiments, the meander or helical elements will provide a substantially omnidirectional radiation pattern.

Furthermore, and most importantly, the particular location and orientation of the dual radiating elements 1*a*, 1*b* and 21*a*, 21*b* respectively, enable a very compact arrangement of the main antenna device totally inside the telephone casing, especially when the radiating elements are supported by a hollow plastic body. It is also convenient to mount the antenna device into the casing, e.g. by a snap fit, and it is therefore suitable for mass production at low cost.

Thanks to the protective layer 7 (FIG. 11), the antenna device can be operated with relatively high power in spite of the location of the antenna device inside the casing. In some embodiments, e.g. the one shown in FIG. 7, the protective layer 7 is preferably mounted directly onto the casing wall, preferably at the inside thereof.

Of course, the antenna device may comprise more than two internal radiating elements extending from a common feed point and each being tuned to a particular resonant frequency.

Moreover, according to a second aspect of the invention, the antenna device may include only one internal radiating element with multiple turns, e.g. a meander element such as the element 1*a* in FIG. 6 or a helical element such as the element 21*a* in FIG. 10, in combination with a rod element 11 being perpendicular to the longitudinal axis of the internal element with multiple turns.

Whenever a rod element 11 is used, it may be positioned in the same plane as the ground plane means 6, or it may be disposed in parallel above or below the ground plane means 6 at a suitable vertical distance therefrom.

Figure 16:
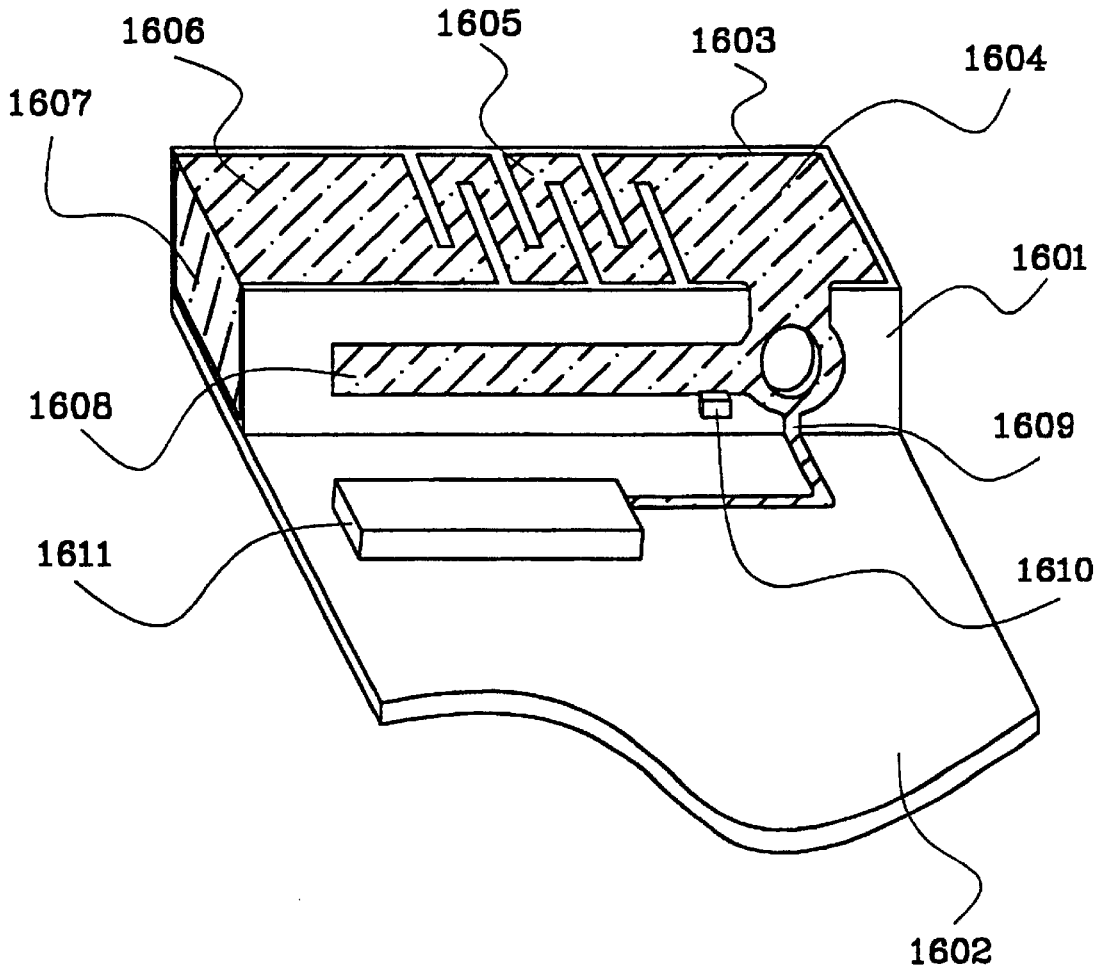
FIG. 16 shows an antenna element according to a seventh preferred embodiment of the invention.

FIG. 16 shows another preferred embodiment according to the invention. A support means is denoted 1601 and a ground plane is denoted 1602. A first radiating element is denoted 1603 and comprises a first patch 1604, a meander shaped portion 1605 and a second patch 1606. The first radiating element 1603 is in conductive contact with a capacitor member 1607 constituting a capacitive load with the ground plane 1602. In this way the antenna means can be made more compact for a given resonance frequency, generally however with some trade-off in gain and relative bandwidth.

A second radiating element is denoted 1608 and is in the form of an elongated straight conductive line. Said first and second radiating elements 1603 and 1608 are in conductive contact with a common feed point 1609. A hole in the support means 1601 enables a rod or whip antenna (not shown) to be connected to the feed point 1609. The rod or whip antenna may be coupled capacitively, inductively or conductively to the feed point 1609. A matching circuit, is denoted 1610 and is used for matching the antenna means to the feeding circuitry schematically shown in FIG. 16 and denoted 1611. The matching circuit 1610 is mounted on one side of the support means 1601 and connected between said second radiating element 1608 and said ground plane 1602.

The matching circuit 1610 may also comprise a balun, which balances the currents, reducing currents in the ground plane and thereby enabling SAR reduction.

The conductive portions, such as the radiating elements, feed point etc, on the support means may be molded or coated directly onto the support means thus eliminating the need for a carrier to be adhered to the support. This can be achieved by molding the radiating portions directly onto the support 1601 using MID (molded interconnection device) techniques. The use of MID technology would simplify mounting of the matching circuit 1610 to the support 1601 since no separate thin plastic carrier is used for the radiating portions. Such plastic carrier may melt or otherwise be damaged in the process of mounting the matching circuit, balun or antenna itself.

The use of the first and second patches 1604 and 1607 enables a generally larger and/or dual bandwidth and improved gain compared to a meander pattern without such patches.

The support means is soldered, screwed, snapped or in any other way known in the art mounted on the ground plane 1602. One further alternative, which is believed to be novel, is using an adhesive tape to mount said support on the PCB. The tape may be completely, partly or not at all conductive.

Figure 17:
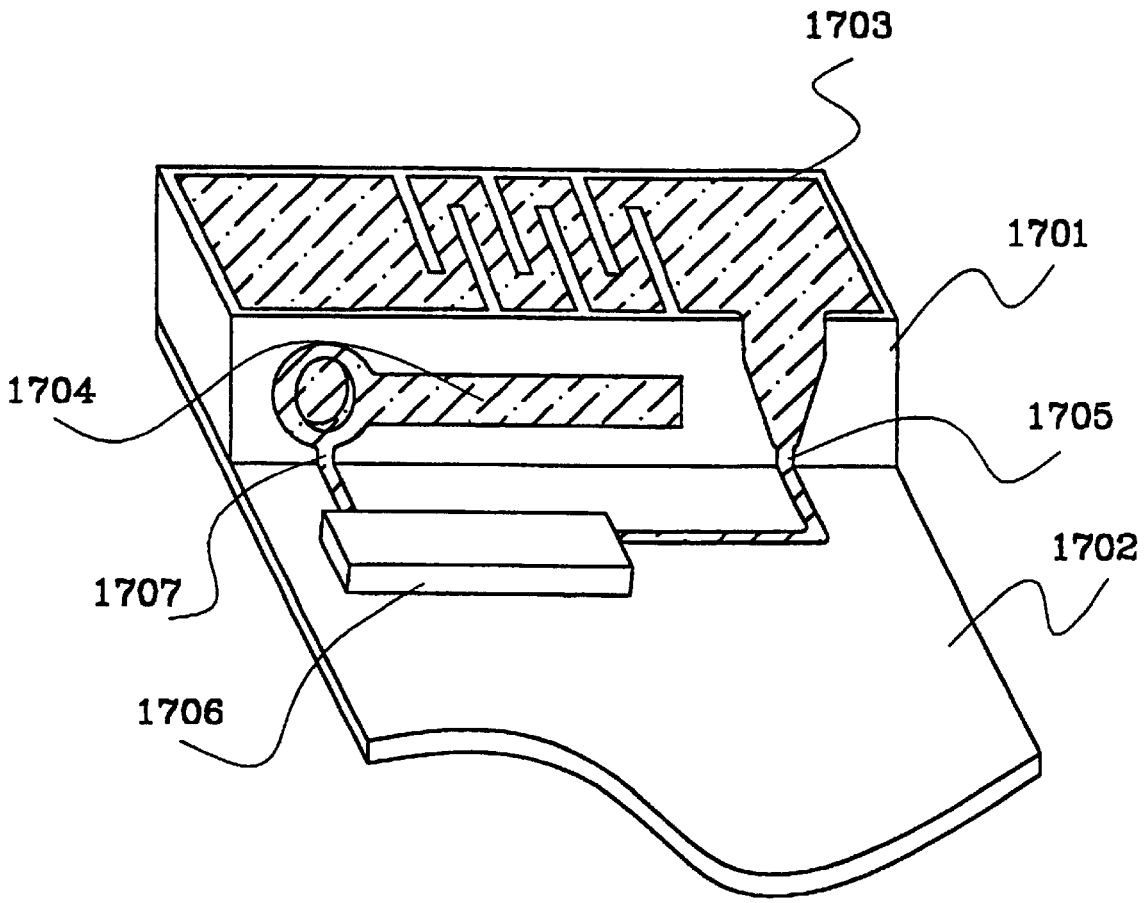
FIG. 17 shows an antenna element according to an eighth preferred embodiment of the invention with different feed points for different radiating elements.

In FIG. 17 is another preferred embodiment shown and with 1701 is a support means denoted and with 1702 is a ground plane denoted. A first radiating element is denoted 1703 and a second radiating element is denoted 1704. A first feed point, denoted 1705, is arranged for feeding RF signals from a circuitry, schematically shown in FIG. 17 and denoted 1706, to said first radiating element 1703. A second feed point denoted 1707 is arranged for feeding RF signals from said circuitry 1706 to said second radiating element 1704. The support means 1701, in this preferred embodiment, is securely fixed using a thin tape provided with an adhesive agent on two sides.

What is claimed is:

1. An antenna device for a hand-portable radio communication unit including a casing, in which a ground plane means having at least one edge is disposed, said antenna device comprising:

first and second radiating elements carried by a support means, said first and second radiating elements being tuned for different resonant frequencies, said first and second radiating elements being disposed in a compact arrangement on said support means and extending from at least one feed point along a longitudinal axis to a first and a second free end, respectively, and said support means for mounting with said first and second radiating elements located adjacent to said at least one edge of said ground plane means so as to be confined entirely in said casing.

2. The antenna device as defined in claim 1, wherein said casing is shaped substantially as an elongated box with the antenna device located adjacent to an end portion thereof and wherein said support means, together with said first and second radiating elements, is dimensioned so as to extend transversely between opposite longer sides of the elongated box constituting the casing.

3. The antenna device as defined in claim 1, wherein each of said first and second radiating elements is extended with its longitudinal axis substantially in parallel to an associated one of said at least one edge.

4. The antenna device as defined in claim 1, wherein said first and second radiating elements are fed with RF signals from a common feed point.

5. The antenna device as defined in claim 1, wherein said first and second radiating elements are fed with RF signals from a first and second feed point, respectively.

6. The antenna device as defined in claim 1, wherein said support means comprises a first and a second side being mutually perpendicular, and said first and second radiating elements being arranged on said first and said second side, respectively.

7. The antenna device as defined in claim 6, wherein said support means further comprises:

a third side being perpendicular to said first and second sides, a first conductive part being arranged on said third side in conductive contact with one end of said first or second radiating element, and said first conductive part extending towards said ground plane means so as to construe a capacitance.

8. The antenna device as defined in claim 1, wherein each of said first and second radiating element extends in a pattern with multiple turns along a longitudinal axis to a first and a second free end.

9. The antenna device as defined in claim 1, wherein at least one of said first or second radiating elements comprises a first patch, an adjoining a meander shaped portion and an adjoining second patch.

10. The antenna device as defined in claim 1, wherein one of said first and second radiating elements is a straight elongated conductive element.

11. The antenna device as defined in claim 1, wherein a third radiating element comprising a rod is connectable to said common feed point so as to be coupled electrically in parallel to said first and second radiating elements.

12. The antenna device as defined in claim 11, wherein said rod is movable between an operative extended position, located at least partially outside said casing, and a retracted position, located substantially inside said casing.

13. The antenna device as defined in claim 1, wherein at least one of said first or second radiating elements is constituted by a flat meander-configured element.

14. The antenna device as defined in claim 1, wherein at least one of said first or second radiating elements are constituted by helical elements (21*a*,21*b*).

15. The antenna device as defined in claim 13, wherein said first and second radiating elements are oriented in line with each other along one and the same edge of said ground plane means.

16. The antenna device as defined in claim 13, wherein said first radiating element is oriented in parallel to a first edge of said ground plane, whereas said second radiating element is oriented substantially at right angle to said first element and in parallel to a second, adjoining edge of said ground plane means.

17. The antenna device as defined in claim 13, wherein said flat meander-configured elements are located in a plane being substantially parallel to said ground plane means.

18. The antenna device as defined in claim 13, wherein said flat meander-configured elements are located in a plane being substantially perpendicular to said ground plane means.

19. The antenna device as defined in claim 1, wherein said support means is shaped like a bar.

20. The antenna device as defined in claim 1, wherein said support means is constituted by a molded body of plastic material.

21. The antenna device as defined in claim 20, wherein said molded body is hollow.

22. The antenna device as defined in claim 1, wherein said first and second radiating elements are mounted on a plastic foil which is securable onto said support means by means of an adhesive agent.

23. The antenna device as defined in claim 22, wherein said plastic foil includes at leaset one flap portion along at least one of its edges.

24. The antenna device as defined in claim 23, wherein a matching circuitry is disposed on said at least one flap portion.

25. The antenna device as defined in claim 1, wherein at least one of said first and second radiating elements is molded directly onto said support.

26. The antenna device in claim 1, wherein a matching circuitry is disposed on said support means.

27. The antenna device as defined in claim 1, wherein said support means is securely fixed by means of using a two-side adhesive material.

28. The antenna device as defined in claim 1, wherein said ground plane means is an electrically conductive layer on a printed circuit board.

29. The antenna device as defined in claim 1, wherein said ground plane means is a metal layer serving as a shielding means on the inside of said casing.

30. The antenna device as defined in claim 1, wherein an electrically resistive layer is disposed in said casing between a part of said casing being designed to be located adjacent to a body portion of a human being, on the one hand, and said first and second radiating elements, on the other hand, said electrically resistant layer serving as a protective device for absorbing electromagnetic radiation which is transmitted from said first and second radiating elements towards said part of the casing.

31. An antenna device for a hand-portable radio communication unit including a casing, in which a ground plane means having at least one edge is disposed, said antenna device comprising at least one radiating element carried by a support means and extending along a longitudinal axis from a feed point to a free end, and a radiating rod element, which is connectable to said feed point so as to be coupled electrically in parallel to said at least one radiating element, said at least one radiating element carried by said support means is an internal element located entirely in said casing with its longitudinal axis oriented substantially in parallel to said one edge of said ground plane means, said longitudinal axis being perpendicular to said rod element.

32. The antenna device as defined in claim 31, wherein internal radiating element is constituted by a flat meander-configured element.

33. The antenna device as defined in claim 31, wherein said internal radiating element is constituted by a helical element.

34. The antenna device as defined in claim 30, wherein said internal element is extending in a pattern with multiple turns along an longitudinal axis from said feed point.

35. A radio communication unit comprising:

an antenna device;

a hand-portable radio communication unit including a casing, in which a ground plane means having at least one edge is disposed;

first and second radiating elements carried by a support means;

said first and second radiating elements being tuned for different resonant frequencies;

said first and second radiating elements being disposed in a compact arrangement on said support means and extending from at least one feed point along a longitudinal axis to a first and a second free end, respectively, and said support means for mounting with said first and second radiating elements located adjacent to said at least one edge of said ground plane means so as to be confined entirely in said casing.

* * * * *